US005522235A

United States Patent [19]

Matsuoka et al.

[11] Patent Number: 5,522,235

[45] Date of Patent: Jun. 4, 1996

[54] REVERSIBLE ROTARY COMPRESSOR AND REVERSIBLE REFRIGERATING CYCLE

[75] Inventors: Fumio Matsuoka; Kisuke Yamazaki, both of Kanagawa; Tomofumi Tezuka, Shizuoka; Tetsuya Mochizuki, Shizuoka; Yoshihiro Tanabe, Shizuoka, all of Japan

[73] Assignee: Mitsubishi Denki Kabushiki Kaisha, Tokyo, Japan

[21] Appl. No.: 235,640

[22] Filed: Apr. 29, 1994

[30] Foreign Application Priority Data

Oct. 27, 1993 [JP] Japan ..... 5-269112

[51] Int. Cl.[6] ..... F04C 17/00

[52] U.S. Cl. ..... 62/324.6; 418/63

[58] Field of Search ..... 62/324.6, 324.1, 62/DIG. 2, 498; 418/63, 248, 249

[56] References Cited

U.S. PATENT DOCUMENTS

| | | | |
|---|---|---|---|
| 167,489 | 9/1875 | Adams | 418/248 |
| 612,868 | 10/1898 | Price et al. | 418/249 |
| 985,562 | 2/1911 | Williams | 418/249 |
| 1,238,764 | 12/1918 | Ulberg | 418/249 |
| 3,936,239 | 2/1976 | Shaw | 417/315 |
| 4,367,638 | 1/1983 | Gray | 62/324.6 |
| 4,445,344 | 5/1984 | Ladusaw | 62/324.6 |
| 4,472,122 | 9/1984 | Yoshida et al. | 418/63 |
| 4,537,567 | 8/1985 | Kawaguchi et al. | 418/63 |
| 4,629,403 | 12/1986 | Wood . | |
| 4,702,088 | 10/1987 | Ozu | 62/324.1 |
| B1 4,983,108 | 7/1992 | Kawaguchi et al. | 418/63 |

FOREIGN PATENT DOCUMENTS

| | | | |
|---|---|---|---|
| 556217 | 7/1932 | Germany . | |
| 3212978 | 10/1983 | Germany . | |
| 60-88887 | 5/1985 | Japan . | |
| 61-44255 | 3/1986 | Japan . | |
| 62-3196 | 1/1987 | Japan . | |
| 62-26457 | 2/1987 | Japan . | |
| 63-135742 | 6/1988 | Japan . | |
| 2215983 | 8/1990 | Japan . | |
| 513363 | 5/1993 | Japan | 418/63 |
| WO90/06447 | 6/1990 | WIPO . | |

*Primary Examiner*—Henry A. Bennet
*Assistant Examiner*—William C. Doerrler
*Attorney, Agent, or Firm*—Oblon, Spivak, McClelland, Maier, & Neustadt

[57] ABSTRACT

The invention concerns a reversible rotary compressor which can compress refrigerant in either of the forward and reverse directions, without providing a valve mechanism in a closed container. In a reversible rotary compressor including a cylinder, a rolling piston, and a slide vane, two inlet/outlet ports are formed in a space between the outer surface of the rolling piston and the inner surface of the cylinder in a state that the two inlet/outlet ports are disposed on both sides of the slide vane. The two inlet/outlet ports are closed by the rolling piston when the rolling piston is positioned at the top dead center and fully opened when the rolling piston is positioned at the bottom dead center. Two refrigerant pipes, coupled with the inlet/outlet ports, are provided in the side wall of the cylinder. The two refrigerant pipes are closed by the rolling piston when the rolling piston when the rolling piston is positioned at the top dead center and fully opened when the rolling piston is positioned at the bottom dead center.

13 Claims, 7 Drawing Sheets

REVERSIBLE ROTARY COMPRESSOR AND REVERSIBLE REFRIGERATING CYCLE

BACKGROUND OF THE INVENTION

The present invention relates to a reversible rotary compressor in which the compressor per se is rotatable in both the forward and reverse directions, and a reversible refrigerating cycle using such a reversible rotary compressor and not using a four-way valve.

FIG. 12 is a conventional reversible rotary compressor disclosed in Published Unexamined Japanese Patent Application No. Sho. 62-3196. In the figure, reference numeral 112 designates a rotor of a motor; 107, a rotary shaft; 118, a valve mechanism; 114, a main bearing; 116, a cylinder; reference character Pa indicates a first refrigerant pipe; Pb, a second refrigerant pipe; 119*a*, an intake hole; and 106, a closed container.

The operation of the reversible rotary compressor thus constructed will be described. In FIG. 12, the rotor 112 is controlled so as to turn the rotary shaft 107 in the forward or reverse direction a refrigerant gas is sucked through the first refrigerant pipe Pa, flows through the valve mechanism 118, the flange part of the main bearing 114 and the intake hole 119*a* as an intake path formed in the cylinder 116, and flows into the cylinder 116. The refrigerant is compressed and discharged into the second refrigerant pipe Pb, through an outlet port and the valve mechanism 118.

When the reversible rotary compressor is operated in a reverse mode, the refrigerant gas sucked through the second refrigerant pipe Pb flows through the valve mechanism 118 and a second intake hole into the cylinder 116. The refrigerant is compressed and discharged into the first refrigerant pipe Pa by way of the intake hole 119*a* and the valve mechanism 118.

In the conventional reversible rotary compressor for a reversible refrigerating cycle, which is thus constructed, a valve mechanism must be provided within the refrigerant pipe 6. Much work is required for assembling the reversible rotary compressor. The cost to manufacture is high. The reliability of the assembled compressor is not high.

SUMMARY OF THE INVENTION

With the view of solving the problems as mentioned above, the present invention has an objective to provide a reversible rotary compressor and a reversible refrigerating cycle, which require no valve mechanism, and are easy to assemble, low in cost and high in reliability.

In order to attain the above-noted and other objectives, The present invention provides a reversible rotary compressor including a cylinder, a rolling piston, and a slide vane, comprising: two inlet/outlet ports being formed in a space between the outer surface of the rolling piston and the inner surface of the cylinder in a state that the two inlet/outlet ports are disposed on respective sides with respect to the slide vane, the two inlet/outlet ports being closed by the rolling piston when the rolling piston is positioned at the top dead center and fully opened when the rolling piston is positioned at the bottom dead center; and a first pair of two refrigerant pipes, each coupled with respective one of inlet/outlet ports, and both being closed by the rolling piston when the rolling piston when the rolling piston is positioned at the top dead center and fully opened when the rolling piston is positioned at the bottom dead center.

A reversible rotary compressor, in a first aspect of the present invention, including a cylinder, a rolling piston, and a slide vane, comprises: two inlet/outlet ports being formed in a space between the outer surface of the rolling piston and the inner surface of the cylinder in a state that the two inlet/outlet ports are disposed on both side closing both ends of the slide vane, the two inlet/outlet ports being closed by the rolling piston when the rolling piston is positioned at the top dead center and fully opened when the rolling piston is positioned at the bottom dead center; and two refrigerant pipes, coupled with the inlet/outlet ports, being provided in one of the side walls of the cylinder.

In the reversible rotary compressor, in a second aspect of the present invention, the two refrigerant pipes respectively coupled with the inlet/outlet ports are provided in the side walls closing both ends of the cylinder, respectively.

In the reversible rotary compressor, in a third aspect of the present invention, two pairs of refrigerant pipes being respectively connected to the two inlet/outlet ports, and being respectively provided in the side walls of the cylinder, each pair of refrigerant pipes being coupled into a single refrigerant pipe.

In the reversible refrigerating cycle, in a fourth aspect of the present invention, the expansion mechanism includes a capillary tube, and the reversible refrigerating cycle comprises a loop formed by connecting the reversible rotary compressor, the expansion mechanism, a room heat exchanger, an outside heat exchanger, in this order, by refrigerant pipes.

In the reversible refrigerating cycle, in a fifth aspect of the present invention, a drive motor for said reversible rotary compressor is a 3-phase motor, a switch for selectively changing the connection of two of three input lines to the 3-phase motor is provided, and the switch operates interlocking with a switch for selecting a heater mode or a cooler mode.

In the reversible refrigerating cycle, in a sixth aspect of the present invention, the switch for selectively changing the connection of two of three input lines to the 3-phase motor also functions to select a heater mode or a cooler mode.

The reversible rotary compressor, in the first aspect of the present invention, compresses refrigerant in either of the forward direction and the reverse direction, without the valve mechanism.

The reversible rotary compressor, in the second aspect of the present invention, compresses refrigerant in either of the forward direction and the reverse direction, without the valve mechanism. The refrigerant is sucked through one of the side walls of the cylinder, and is discharged through the other side wall.

The reversible rotary compressor, in the third aspect of the present invention, compresses refrigerant in either of the forward direction and the reverse direction, without the valve mechanism. The refrigerant is sucked through both side walls of the cylinder, and is discharged through both side walls.

The reversible rotary compressor, in the fourth aspect of the present invention, compresses refrigerant in either of the forward direction and the reverse direction. Accordingly, the reversible rotary compressor not requiring the four-way valve may be constructed. Further, the reversible rotary compressor is constructed by directly connecting a room heat exchanger and an outside heat exchanger by refrigerant pipes. Accordingly, the reversible rotary compressor wet compresses incoming refrigerant.

In the reversible refrigerating cycle, in the fifth aspect of the present invention, a switch operates to selectively change the connection of two of three input lines to the 3-phase motor is provided, while interlocking with a switch for selecting a heater mode or a cooler mode. With this, the reversible rotary compressor turns forwardly or reversely.

In the reversible refrigerating cycle, in a sixth aspect of the present invention, through the operation of the switch for selectively changing the connection of two of three input lines to the 3-phase motor for driving the reversible rotary compressor, the reversible rotary compressor turns forwardly or reversely, to select a heater mode or a cooler mode.

DETAILED DESCRIPTION OF THE PREFERRED EMBODIMENTS

Preferred embodiments of the present invention will be described with reference to the accompanying drawings.

<1st Embodiment>

Figure 1:
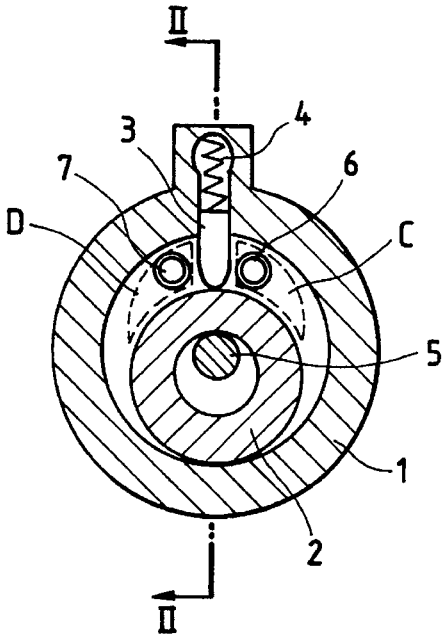
FIG. 1 is a traverse sectional view showing a reversible rotary compressor according to a first embodiment of the present invention.

FIG. 1 is a traverse sectional view showing a reversible rotary compressor according to a first embodiment of the present invention. In the figure, reference numeral 1 designates a cylinder; 2, a rolling piston; 3, a slide vane; 4, a spring for pressing the slide vane 3 against the rolling piston 2; 5, a crank shaft of the rolling piston 2; C and D, inlet/outlet ports, which are symmetrically disposed on both sides of the slide vane 3 in a space between the inner surface of the cylinder 1 and the outer surface of the rolling piston 2; 6, a refrigerant pipe for supplying refrigerant to the inlet/outlet port C or discharging the refrigerant from the same; and 7, a refrigerant pipe for supplying refrigerant to the inlet/outlet port D and discharging the refrigerant from the same. The refrigerant pipes 6 and 7 are closed by the rolling piston 2 when it reaches the top dead center, and is opened when it reaches the bottom dead center.

Figure 2:
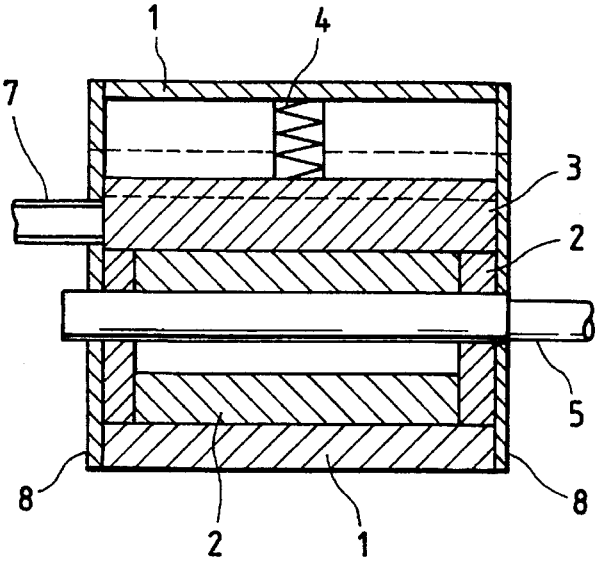
FIG. 2 is a cross sectional view taken on line II—II in FIG. 1.

FIG. 2 is a cross sectional view taken on line II—II in FIG. 1. Reference numeral 8 designates a side wall of the cylinder 1 and 7, a refrigerant pipe for supplying refrigerant to the outlet port D and discharging the refrigerant from the same.

Figure 3:
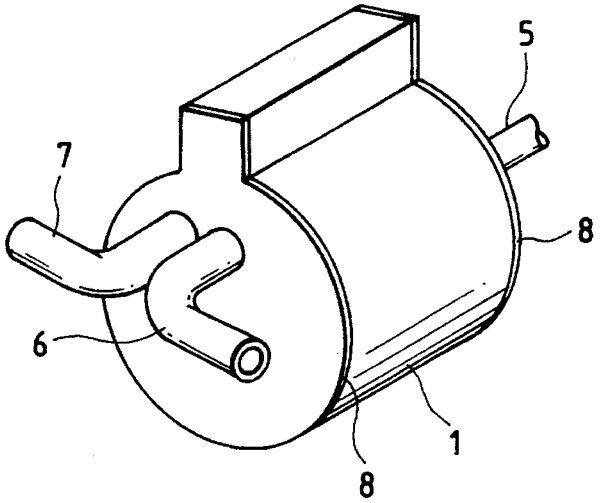
FIG. 3 is a perspective view showing an external appearance of the reversible rotary compressor of FIG. 1.

FIG. 3 is a perspective view showing an external appearance of the reversible rotary compressor of FIG. 1. The refrigerant pipes 6 and 7 respectively coupled with the inlet/outlet ports C and D are provided in only one side wall 8 of the cylinder 1.

Figure 4:
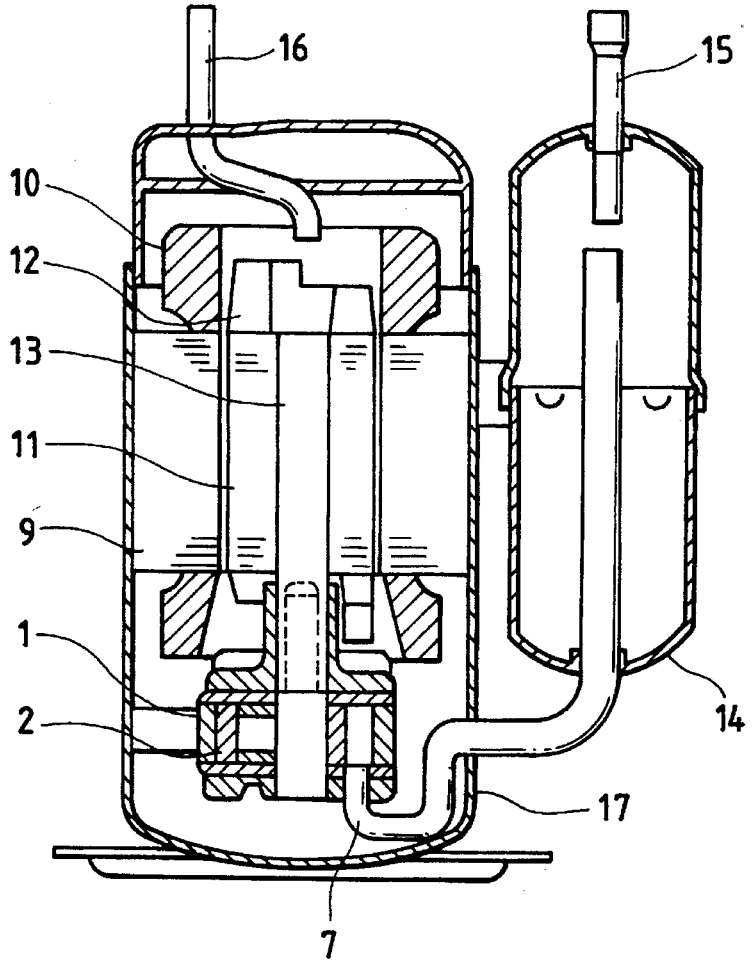
FIG. 4 is a longitudinal sectional view showing the reversible rotary compressor of FIG. 1 when it is combined with a motor.

FIG. 4 is a longitudinal sectional view showing the reversible rotary compressor of FIG. 1 when it is combined with a motor. In the figure, reference numeral 9 designates a stator of a motor; 10, a stator coil; 11, a rotor of the motor; 12, a cooling fan; 13, a rotary shaft of the motor, directly coupled with the crank shaft 5; 14, a muffler; 15 and 16, refrigerant pipes for supplying refrigerant to the reversible rotary compressor by way of the muffler 14 and the motor or discharging the same from the reversible rotary compressor; and 17, a closed container.

Figure 5:
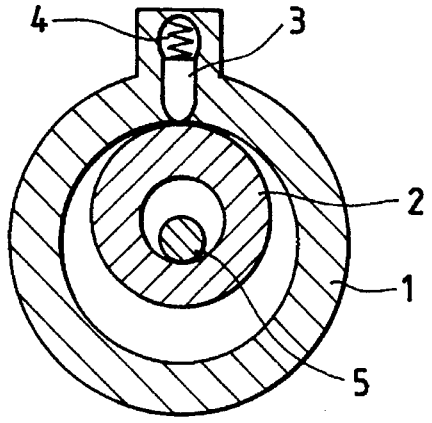
FIG. 5 is a cross sectional view showing the reversible rotary compressor of FIG. 1 when a rolling piston reaches the top dead center.

FIG. 5 is a cross sectional view showing the reversible rotary compressor of FIG. 1 when a rolling piston reaches the top dead center. Incidentally, a state of the reversible rotary compressor when the rolling piston 2 is at the bottom dead point is illustrated in FIG. 1.

The operation of the first embodiment will be described. The reversible rotary compressor shown in FIG. 1 is made up of the cylinder 1, the rolling piston 2, and the slide vane 3. In a space between the inner surface of the cylinder 1 and the outer surface of the rolling piston 2 of the reversible rotary compressor, the inlet/outlet port C and the inlet/outlet port D are disposed, symmetrically with respect to the slide vane 3, at a location where these ports are closed when the rolling piston 2 is positioned at the top dead center and opened when the rolling piston 2 is at the bottom dead center. The refrigerant pipes 6 and 7, connected to the inlet/outlet ports C and D, are provided in only one side wall 8.

Figure 6:
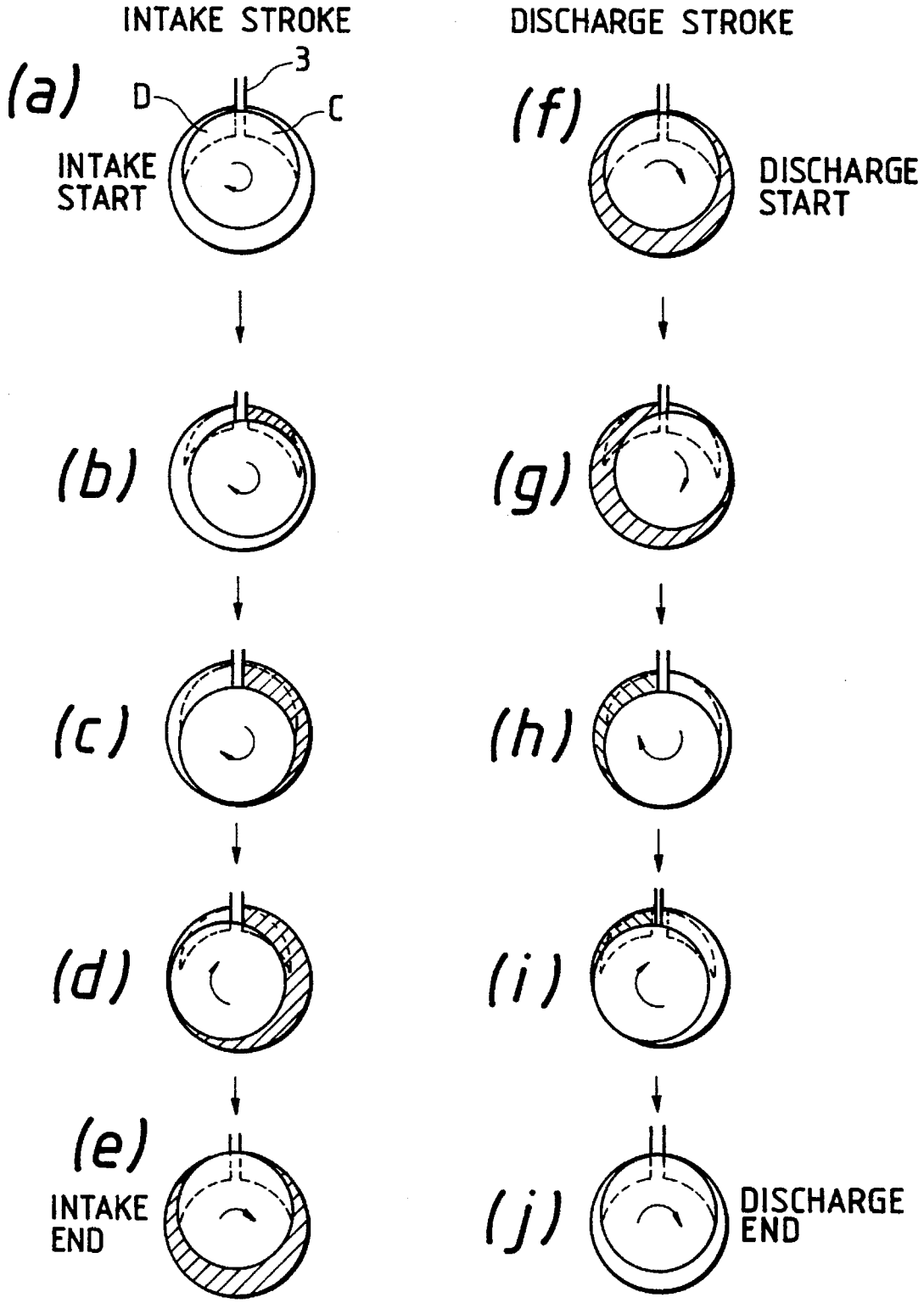
FIG. 6 is a detailed transient diagram for explaining an intake stroke and a discharge stroke of the reversible rotary compressor of FIG. 1, including parts (a) to (j).

FIG. 6 is a detailed transient diagram for explaining an intake stroke and a discharge stroke of the reversible rotary compressor of FIG. 1.

In the figure, the inlet/outlet port C serves as an inlet port and the inlet/outlet port D, as an outlet port. In the part (a) of FIG. 6, the refrigerant pipe 6 is closed by the rolling piston 2. As the rolling piston 2 turns, the refrigerant pipe 6 is progressively opened and the refrigerant is progressively supplied to the inlet/outlet port C. The rolling piston 2 further turns and the rolling piston 2 reaches the bottom dead center (the part (c) of FIG. 6). At this time, the refrigerant pipe 6 and the inlet/outlet port C are fully opened, and a normal supply of the refrigerant to the inlet/outlet port C is set up. With a further turn of the rolling piston 2, the refrigerant pipe 6 is progressively closed, and then the rolling piston 2 reaches the top dead center again. At this time, the refrigerant pipe 6 and the inlet/outlet port C are closed, and the intake stroke is completed. This state is illustrated in the part (e) of FIG. 6.

The rolling piston 2 starts the second turn (the part (f) of FIG. 6). The refrigerant staying in the space between the inner surface of the cylinder 1 and the outer surface of the rolling piston 2 of the reversible rotary compressor, except the slide vane 3, is progressively supplied to the inlet/outlet port D, while being compressed. At this time, the refrigerant pipe 7 is progressively opened. The refrigerant is progressively discharged from the refrigerant pipe 7. The rolling piston 2 further turns, and reaches the bottom dead center (the part (h) of FIG. 6). At this time, the refrigerant pipe 7 and the inlet/outlet port D are fully opened, so that the refrigerant in the inlet/outlet port D is progressively discharged from the refrigerant pipe 7. The rolling piston 2 is further turned. The refrigerant pipe 7 is progressively closed, and the rolling piston 2 reaches the top dead center. At this time, the refrigerant pipe 7 and the inlet/outlet port D are completely closed, and the discharge stroke is completed. This state is illustrated in the part (j) of FIG. 6.

The refrigerant pipe 7 starts to discharge the refrigerant while at the same time the refrigerant pipe 6 is gradually opened. The refrigerant is gradually supplied to the inlet/outlet port C. Concurrently with the discharge stroke, the intake stroke starts. This state is illustrated in the part (h) of FIG. 6.

Thus, the refrigerant is continuously sucked and compressed without communicating the inlet/outlet port C with the inlet/outlet port D, on both sides of the slide vane 3. Since the reversible rotary compressor of the first embodiment is symmetrically constructed, the compressor operates in a similar way also in a reverse mode.

In the first embodiment, the refrigerant pipes 6 and 7 are provided in only one of the side walls of the cylinder 1. Because of this, the working of only one side wall is required. This reduces the number of working steps.

<2nd Embodiment>

Figure 7:
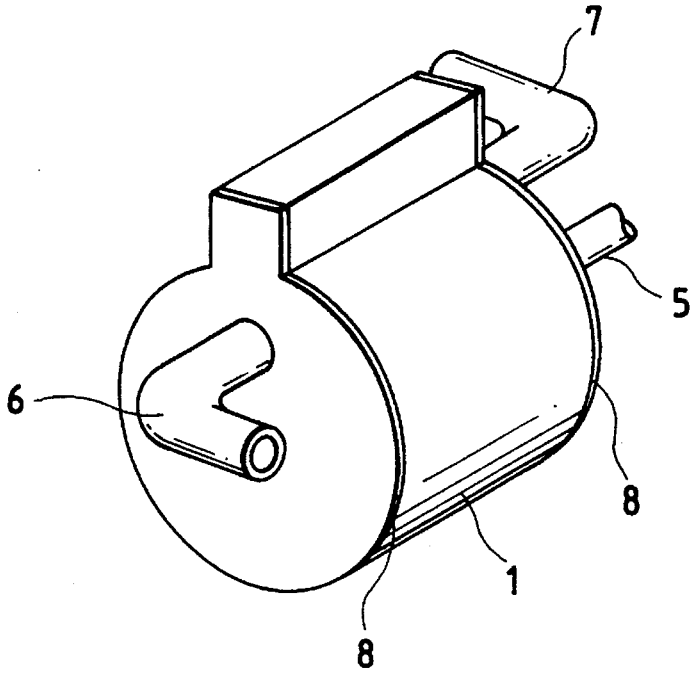
FIG. 7 is a perspective view showing an external appearance of a reversible rotary compressor according to a third embodiment of the present invention.

As described above, in the first embodiment, the refrigerant pipe 6 and the refrigerant pipe 7 connected to the inlet/outlet ports C and D are provided in only one side wall 8 of the cylinder 1. If required, those refrigerant pipes may be arranged such that the refrigerant pipe 6 connected to the inlet/outlet port C is provided in one side wall 8 of the cylinder 1, and the refrigerant pipe 7 connected to the inlet/outlet port D is provided in the other side wall 8 (FIG. 7).

In this arrangement of the refrigerant pipes, the flow of the refrigerant is unidirectional and hence smooth.

<3rd Embodiment>

Figure 8:
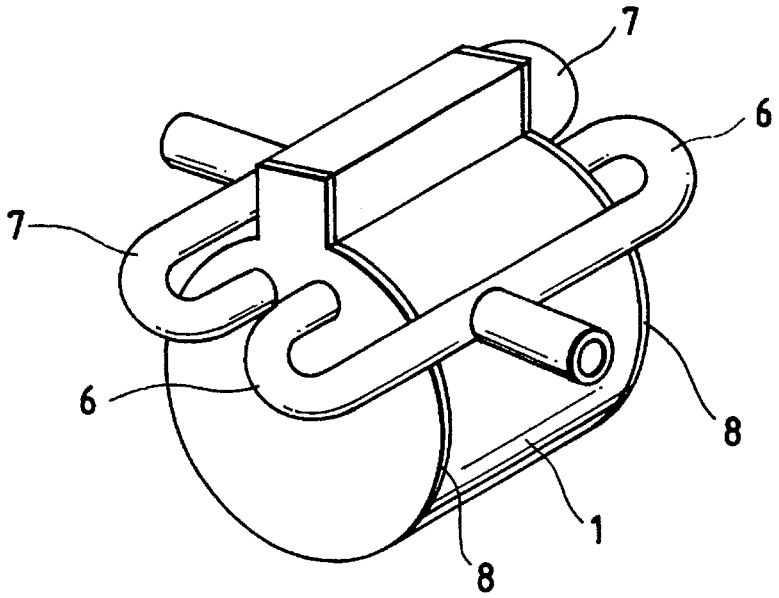
FIG. 8 is a perspective view showing an external appearance of a reversible rotary compressor according to a fourth embodiment of the present invention.

FIG. 8 is a perspective view showing an external appearance of a reversible rotary compressor according to a third embodiment of the present invention. In this embodiment, the refrigerant pipes 6 and 7 connected to the inlet/outlet ports C and D are each coupled with both side walls 8 of the cylinder 1, as shown.

Such a connection of the refrigerant pipes can uniformly supply the refrigerant into the cylinder 1, so that the refrigerant is smoothly compressed. Further, the intake area is doubled, leading to reduction of intake loss.

<4th Embodiment>

Figure 9:
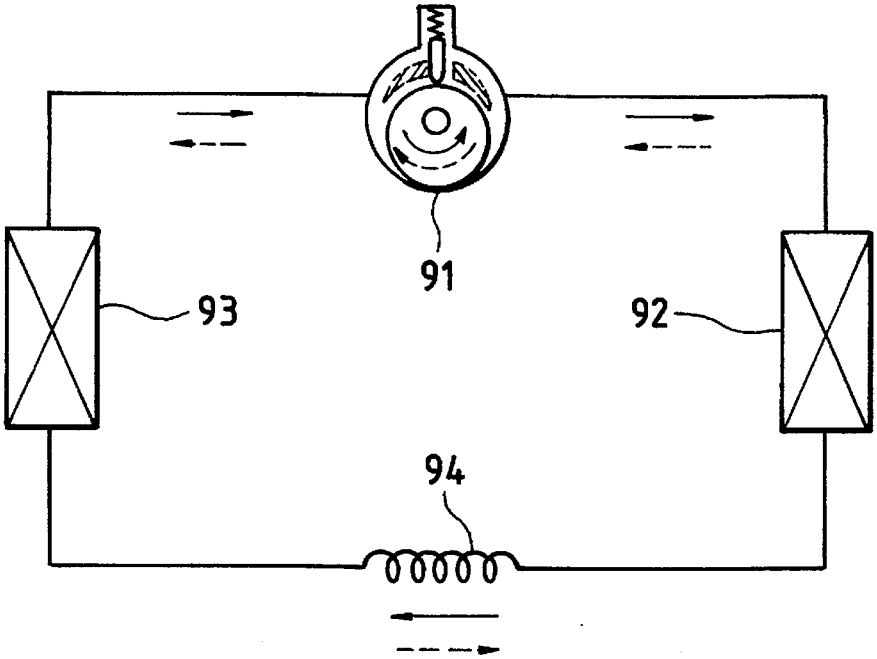
FIG. 9 is a diagram showing a reversible refrigerating cycle according to the present invention.

FIG. 9 is diagram showing a reversible refrigerating cycle according to the present invention. In the figure, reference numeral 91 designates a :reversible rotary compressor according to any of the first to third embodiments; 92, a room heat exchanger; 93, an outside heat exchanger; and 94, an expansion mechanism using a capillary tube. In the fourth embodiment, the room heat exchanger 92 and the reversible rotary compressor 91 are directly connected by a refrigerant pipe, and the outside heat exchanger 93 and the reversible rotary compressor 91 are connected by another refrigerant pipe. No gas-liquid separator is used.

In the figure, a solid line with an arrow head indicates a flow of refrigerant in a heater mode. A broken line with an arrow head indicates a flow of refrigerant in a cooler mode. In a heater mode, the reversible rotary compressor 91 rotates as indicated by the solid line arrows. The refrigerant circulates through a loop including the reversible rotary compressor 91, the room heat exchanger 92, the expansion mechanism 94, and the outside heat exchanger 93 in this order. In a cooler mode, the reversible rotary compressor 91 reversely turns, so that the refrigerant circulates through the loop as indicated by the broken line arrows.

Figure 10:
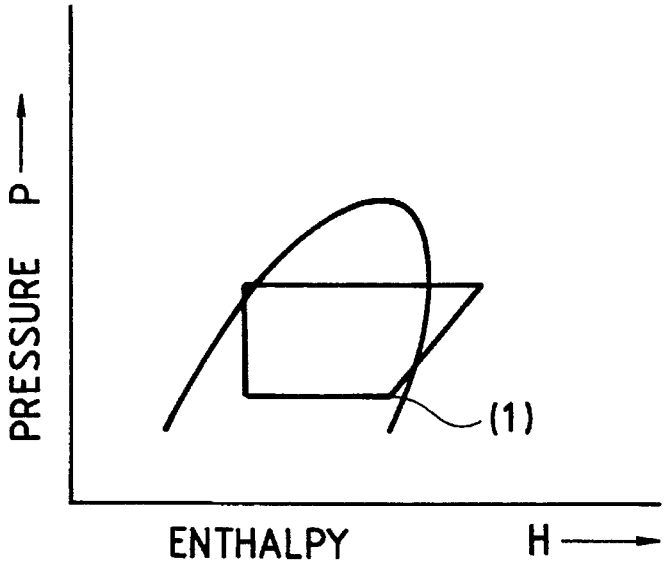
FIG. 10 is a Mollier diagram of the refrigerating cycle according to the present invention.
Figure 13:
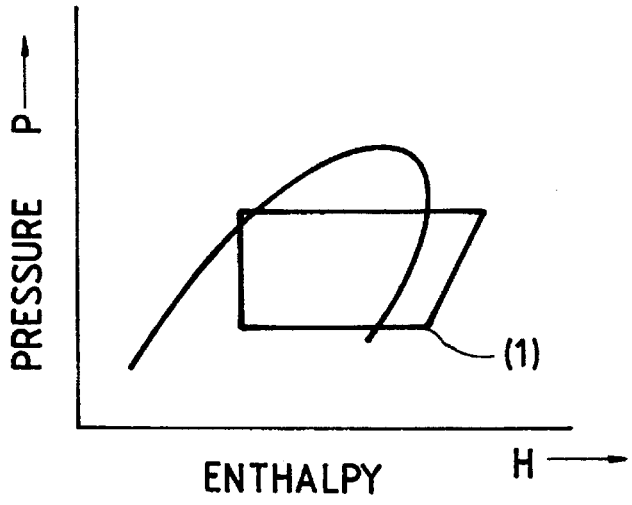
FIG. 13 PRIOR ART
FIG. 13 is a Mollier diagram of a conventional refrigerating cycle.

In a conventional refrigerating cycle, the rotary compressor includes a discharge valve. This discharge valve is easily affected by the liquid compression. As seen from a Mollier diagram in FIG. 13, superheat gas must be used for the compressor intake refrigerant (1). In the fourth embodiment, the reversible rotary compressor 91 is not provided with a discharge valve or the component easy to be affected by the liquid compression. Accordingly, use of the liquid compression is allowed. Accordingly, as seen from FIG. 10, the compressor intake refrigerant (1) may be a wet steam. For this reason, the capillary tube having a less resistance than the conventional one is used in design.

Thus, in the fourth embodiment, the reversible rotary compressor 91 is operable, with the intake refrigerant being in a wet state. Therefore, discharge temperature may be reduced, and the reliability of the compressor is improved. A specific volume of the refrigerant is small. A circulating quantity of the refrigerant, i.e., the compressing capability, is increased, viz., the compressing efficiency is improved.

<5th Embodiment>

Figure 11:
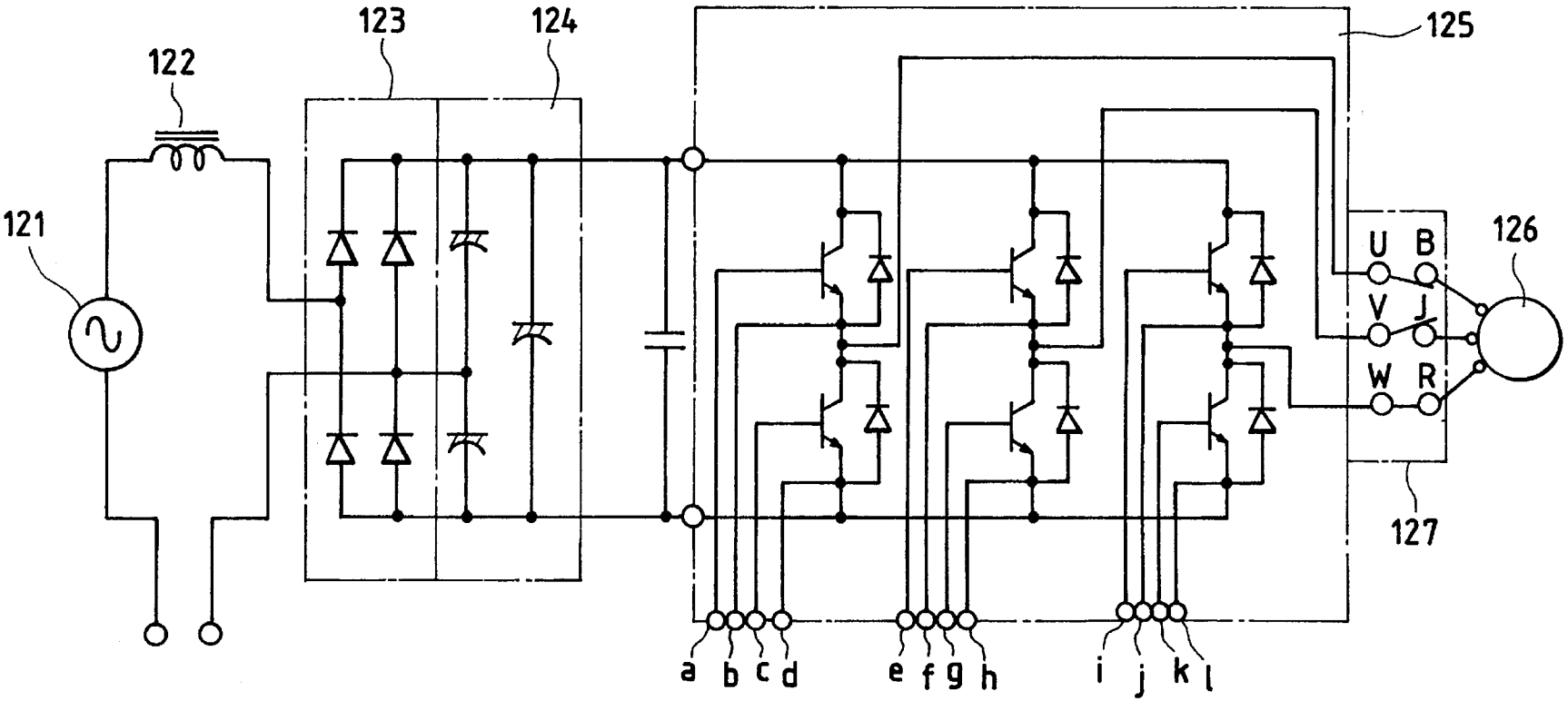
FIG. 11 is a circuit diagram showing a 3-phase motor for the refrigerating cycle according to a fifth embodiment of the present invention.
Figure 12:
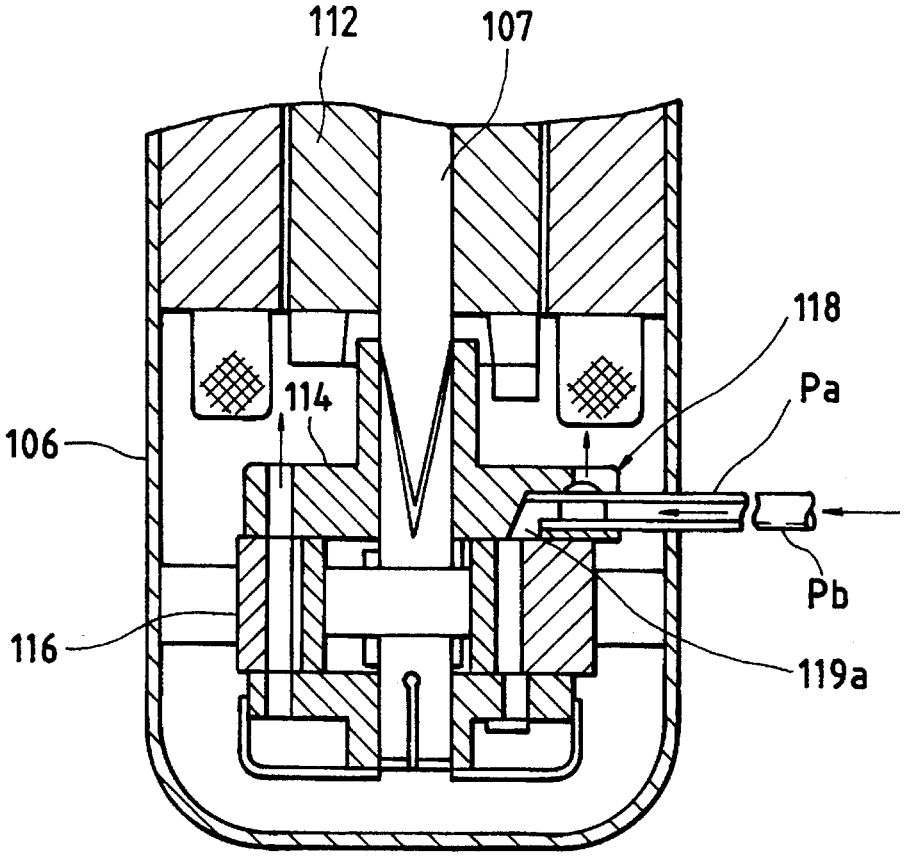
FIG. 12 PRIOR ART
FIG. 12 is a cross sectional view showing a conventional reversible rotary compressor.

FIG. 11 is a circuit diagram showing a circuit for driving a 3-phase motor to operate the reversible rotary compressor. In the figure, reference numeral 121 designates a commercial power source; 122, an inductor 122 for current restriction; 123, a full-wave rectifier for full-wave rectifying the current from the commercial power source 121 into a direct current (DC) containing pulsating components; and 124, a smoothing circuit 124, including a capacitor, for smoothing the DC to remove the pulsating components from the DC. A DC–AC invertor 125 converts the smoothed DC into 3-phase alternating currents (AC), 120° phase shifted, and controls a motor speed of the 3-phase motor 126 by controlling the frequency in accordance with a thermal load. In the circuit, each phase contains two sets each consisting of a transistor and a diode.

In FIG. 11, input terminals a to l are provided for phase and frequency control signals in the DC–AC invertor 125. U, V and W indicate output terminals of the DC–AC invertor 125 through which 3-phase AC currents, 120° C. phase shifted, are output. Reference numeral 126 indicates a 3-phase motor directly coupled with the compressor, and reference characters B, J, and R, input terminals of the 3-phase motor 126. A switch 127 is operated to select the forward turn or the reverse turn of the 3-phase motor 126 in association with the operation of a switch (not shown) for selecting a heater mode or a cooler mode. Specifically, connection of two output terminals of the invertor circuit and the two input terminals of the 3-phase motor are changed, by this switch, to another connection. For example, connection of U–B and V–J are changed to another connection U–J and V–B.

The operation of the 3-phase motor circuit thus arranged will be described.

A DC current supplied from the commercial power source 121 is rectified and smoothed by the full-wave rectifier 123 and the smoothing circuit 124. The rectified and smoothed DC current controls the on/off switching operation of the transistors in the DC–AC invertor 125. As a result, the DC–AC invertor 125 produces AC currents, 120° phase shifted. The AC currents drive the 3-phase motor 126 to operate the reversible rotary compressor.

In the DC–AC invertor 125, signals, defined by a thermal load, are input to the input terminals a to l, and control the on/off switching operations of the transistors. As a result, the frequency of the AC current is controlled, the motor speed of the 3-phase motor 126 is controlled, and the capability of the reversible rotary compressor is controlled.

The switch 127, interlocking with the switch for selecting a heater mode or a cooler mode, is operated to change the connection of two output terminals of the DC–AC invertor 125 and the two input terminals of the 3-phase motor 126 to another connection, for example, U–B and V–J to U–J and V–B. Through the operation of the switch 127, the reversible rotary compressor is turned forwardly or reversely, so that the refrigerating cycle is switched between a heater mode and a cooler mode.

<6th Embodiment>

The switch for changing the turning direction of the 3-phase motor 126 by changing the connection of the two output terminals of the DC–AC invertor 125 and the two input terminals of the 3-phase motor 126 to another connection of them, may be used also as the switch for selecting the heat mode or the cooler mode.

A reversible rotary compressor of the first embodiment of the present invention, including a cylinder, a rolling piston, and a slide vane, comprises: two inlet/outlet ports being formed in a space between the outer surface of the rolling piston and the inner surface of the cylinder in a state that the two inlet/outlet ports are disposed on both sides of the slide vane, the two inlet/outlet ports being closed by the rolling piston when the rolling piston is positioned at the top dead center and fully opened when the rolling piston is positioned at the bottom dead center; and two refrigerant pipes, coupled with the inlet/outlet ports, being provided in the side wall of the cylinder. Therefore, the reversible rotary compressor compresses refrigerant in either of the forward direction and the reverse direction, without the valve mechanism.

In the reversible rotary compressor of the second embodiment of the present invention, the first refrigerant pipe 6 connected to the first inlet/outlet port is provided in the first side wall 5 of the cylinder 1. The second refrigerant pipe 6 connected to the second inlet/outlet port is provided in the second side wall 5 of the cylinder 1. The refrigerant enters through one side wall of the cylinder and emanates from the other. The flow of the refrigerant is smooth.

In the third embodiment, the refrigerant pipes connected to the inlet/outlet ports C and D are provided in both side walls of the cylinder 1. Accordingly, the reversible rotary compressor can compress the refrigerant in either of the forward and reverse directions, without the valve mechanism. The refrigerant enters through both side walls of the cylinder and emanates from both side walls. Accordingly, the refrigerant is uniformly supplied into the cylinder 1, so that the refrigerant is smoothly compressed. Further, the intake area is doubled, leading to reduction of intake loss.

In the reversible refrigerating cycle of the forth embodiment, the expansion mechanism includes a capillary tube, and the reversible refrigerating cycle comprises a loop formed by connecting the reversible rotary compressor, the expansion mechanism, a room heat exchanger, an outside heat exchanger, in this order, by refrigerant pipes. Accordingly, the reversible rotary compressor not requiring the four-way valve may be constructed. Further, the reversible rotary compressor wet compresses incoming refrigerant. A specific volume of the refrigerant is small. A circulating quantity of the refrigerant, i.e., the compressing capability, is increased, viz., the compressing efficiency is improved.

In the reversible refrigerating cycle of the fifth embodiment, a drive motor for said reversible rotary compressor is a 3-phase motor, a switch for selectively changing the connection of two of three input lines to the 3-phase motor is provided, and the switch operates interlocking with a switch for selecting a heater mode or a cooler mode. With a simple construction, the motor can be forwardly or reversely turned by operating the switch for selecting a cooler mode or a heater mode. Accordingly, the reversible rotary compressor can be turned forwardly or reversely, to change the refrigerating cycle to a heater mode or a cooler mode.

In the reversible refrigerating cycle of the sixth embodiment, a drive motor for said reversible rotary compressor is a 3-phase motor, and the switch for selectively changing the connection of two of three input lines to the 3-phase motor also functions to select a heater mode or a cooler mode. The required number of switches is reduced by one.

What is claimed is:

1. A reversible rotary compressor including a cylinder having side walls closing both ends, a rolling piston, and a slide vane, comprising:

two inlet/outlet ports being formed in a space between the outer surface of the rolling piston and an inner surface of the cylinder in a state that the two inlet/outlet ports are disposed on respective sides with respect to the slide vane, the two inlet/outlet ports being closed by the rolling piston when the rolling piston is positioned at top dead center and fully opened when the rolling piston is positioned at bottom dead center; and a first pair of two refrigerant pipes, each coupled with a respective one of two inlet/outlet ports, and both being closed by the rolling piston when the rolling piston is positioned at top dead center and fully opened when the rolling piston is positioned at bottom dead center;

wherein one of said refrigerant pipes is provided in one of the side walls of the cylinder, while the other of said refrigerant pipes is provided in the other of the side walls.

2. The compressor according to claim 1, further comprising:

a second pair of two refrigerant pipes, each coupled with respective one of inlet/outlet ports, and both being closed by the rolling piston when the rolling piston is positioned at the top dead center and fully opened when the rolling piston is positioned at the bottom dead center.

3. The compressor according to claim 2, wherein the refrigerant pipes of said first and second pair, coupled with the same inlet/outlet port, is jointed into a single refrigerant pipe.

4. The compressor according to claim 1, wherein the compressor is disposed in a reversible refrigerant cycle including an expansion mechanism having a capillary tube, a room heat exchanger, and an outside heat exchanger.

5. A reversible refrigerating cycle comprising a loop formed by connecting a reversible rotary compressor, an expansion mechanism having a capillary tube, a room heat exchanger, and an outside heat exchanger, in this order, by refrigerant pipes, wherein said reversible rotary compressor includes: a cylinder having side walls closing both ends; a rolling piston; a slide vane; two inlet/outlet ports being formed in a space between the outer surface of the rolling piston and the inner surface of the cylinder in a state that the two inlet/outlet ports are disposed on respective sides with respect to the slide vane, the two inlet/outlet ports being closed by the rolling piston when the rolling piston is positioned at top dead center and fully opened when the rolling piston is positioned at bottom dead center; and a first pair of refrigerant pipes, each coupled with a respective one of said two inlet/outlet ports, and both being closed by the rolling piston when the rolling piston is positioned at top dead center and fully opened when the rolling piston is positioned at bottom dead center;

wherein one of said refrigerant pipes is provided in one of the side walls of the cylinder, while the other of said refrigerant pipes is provided in the other of the side walls.

6. The reversible refrigerating cycle according to claim 5, wherein a drive motor for said reversible rotary compressor is a 3-phase motor, a switch for selectively changing the connection of two of three input lines to the 3-phase motor is provided, and the switch operates interlocking with a switch for selecting a heater mode or a cooler mode.

7. The reversible refrigerating cycle according to claim 6, wherein the switch for selectively changing the connection of two of three input lines to the 3-phase motor also functions to select a heater mode or a cooler mode.

8. A reversible rotary compressor including a cylinder, a rolling piston, and a slide vane, comprising:

a first pair of inlet/outlet ports being formed in a space between the outer surface of the rolling piston and an inner surface of a first side wall of the cylinder in a state that the first pair of inlet/outlet ports are disposed on respective sides with respect to the slide vane, the first pair of inlet/outlet ports being closed by the rolling piston when the rolling piston is positioned at top dead center and fully opened when the rolling piston is positioned at bottom dead center;

a first pair of refrigerant pipes, each coupled with a respective one of said first pair of inlet/outlet ports, and both being closed by the rolling piston when the rolling piston is positioned at top dead center and fully opened when the rolling piston is positioned at bottom dead center;

a second pair of inlet/outlet ports being formed in a space between the outer surface of the rolling piston and an inner surface of a second side wall of the cylinder in a state that the second pair of inlet/outlet ports are disposed on respective sides with respect to the slide vane, the second pair of inlet/outlet ports being closed by the rolling piston when the rolling piston is positioned at top dead center and fully opened when the rolling piston is positioned at bottom dead center; and a second pair of refrigerant pipes, each coupled with a respective one of said second pair of inlet/outlet ports, and both being closed by the rolling piston when the rolling piston is positioned at top dead center and fully opened when the rolling piston is positioned at bottom dead center.

9. The reversible rotary compressor of claim 8, wherein one of said first pair of refrigerant pipes is connected to one of said second pair of refrigerant pipes, and the other of said first pair of refrigerant pipes is connected to the other of said second pair of refrigerant pipes.

10. A reversible refrigerating cycle comprising a loop formed by connecting a reversible rotary compressor, an expansion mechanism having a capillary tube, a room heat exchanger, and an outside heat exchanger, in this order, by refrigerant pipes, wherein said reversible rotary compressor includes: a cylinder; a rolling piston; and a slide vane;

a first pair of inlet/outlet ports being formed in a space between the outer surface of the rolling piston and an inner surface of a first side wall of the cylinder in a state that the first pair of inlet/outlet ports are disposed on respective sides with respect to the slide vane, the first pair of inlet/outlet ports being closed by the rolling piston when the rolling piston is positioned at top dead center and fully opened when the rolling piston is positioned at bottom dead center; and a first pair of refrigerant pipes, each coupled with a respective one of said first pair of inlet/outlet ports, and both being closed by the rolling piston when the rolling piston is positioned at top dead center and fully opened when the rolling piston is positioned at bottom dead center; and a second pair of inlet/outlet ports being formed in a space between the outer surface of the rolling piston and an inner surface of a second side wall of the cylinder in a state that the second pair of inlet/outlet ports are disposed on respective sides with respect to the slide vane, the second pair of inlet/outlet ports being closed by the rolling piston when the rolling piston is positioned at top dead center and fully opened when the rolling piston is positioned at bottom dead center; and a second pair of refrigerant pipes, each coupled with a respective one of said second pair of inlet/outlet ports, and both being closed by the rolling piston when the rolling piston is positioned at top dead center and fully opened when the rolling piston is positioned at bottom dead center.

11. The reversible refrigerating cycle according to claim 10, wherein a drive motor for said reversible rotary compressor is a 3-phase motor, a switch for selectively changing the connection of two of three input lines to the 3-phase motor is provided, and the switch operates interlocking with a switch for selecting a heater mode or a cooler mode.

12. The reversible refrigerating cycle according to claim 11, wherein the switch for selectively changing the connection of two or three input lines to the 3-phase motor also functions to select a heater mode or a cooler mode.

13. The reversible rotary compressor of claim 10, wherein one of said first pair of refrigerant pipes is connected to one of said second pair of refrigerant pipes, and the other of said first pair of refrigerant pipes is connected to the other of said second pair of refrigerant pipes.

* * * * *